US008857744B2

(12) United States Patent
Kozey

(10) Patent No.: US 8,857,744 B2
(45) Date of Patent: Oct. 14, 2014

(54) SPRINKLER HEAD HOSE ADAPTER

(75) Inventor: Gregory Kozey, Eastford, CT (US)

(73) Assignee: Kochek Company, Inc., Putnam, CT (US)

( * ) Notice: Subject to any disclaimer, the term of this patent is extended or adjusted under 35 U.S.C. 154(b) by 276 days.

(21) Appl. No.: 13/314,660

(22) Filed: Dec. 8, 2011

(65) Prior Publication Data

US 2012/0145813 A1 Jun. 14, 2012

Related U.S. Application Data

(60) Provisional application No. 61/420,966, filed on Dec. 8, 2010.

(51) Int. Cl.
*B05B 1/00* (2006.01)
*B05B 15/06* (2006.01)

(52) U.S. Cl.
CPC ..... *B05B 15/066* (2013.01)
USPC ..... 239/600; 239/525; 239/530; 239/390; 239/397; 239/587.1; 239/588; 285/272

(58) Field of Classification Search
USPC ..... 239/525, 526, 530, 390, 397, 587.1, 239/588, 600; 285/272
See application file for complete search history.

(56) References Cited

U.S. PATENT DOCUMENTS

| | | | | |
|---|---|---|---|---|
| 6,877,172 | B2 * | 4/2005 | Malek et al. | 239/588 |
| 7,083,120 | B2 * | 8/2006 | Gilpatrick et al. | 239/397 |
| 2006/0237964 | A1 * | 10/2006 | Nielson | 285/272 |

* cited by examiner

*Primary Examiner* — Steven J Ganey
(74) *Attorney, Agent, or Firm* — MKG, LLC

(57) ABSTRACT

In a sprinkler head hose adapter, a swivel adapter is rotatably coupled to a head adapter. The swivel adapter defines a bore that extends therethrough and that is in fluid communication with a conduit coupled to the swivel adapter. A coupler is positioned in an end of the conduit and includes a bore in fluid communication with the conduit. A portion of the coupler extends outwardly from the coupler and can be attached to a hose or other apparatus forming part of a sprinkler system.

8 Claims, 3 Drawing Sheets

SPRINKLER HEAD HOSE ADAPTER

CROSS REFERENCE TO RELATED APPLICATION

This application claims priority benefit under 35 U.S.C. §119(e) of U.S. Provisional Patent Application Ser. No. 61/420,966, filed Dec. 8, 2010, which is hereby incorporated by reference in its entirety.

BACKGROUND

Irrigation systems find utility in a wide variety of applications. For example, irrigation systems are employed to provide water for irrigating fields, golf courses, lawns, and the like. Typically, an irrigation system includes underground and above-ground portions. These portions of the irrigation system typically include conduits for liquid conveyance, control valves to regulate the flow of liquid through the conduits, and sprinkler heads to distribute liquid to a desired location. The sprinkler head may sometimes need to be positioned at a location other than where the conduit extends above-ground.

SUMMARY OF THE INVENTION

The present invention is directed in one aspect to a sprinkler head hose adapter that includes a swivel adapter coupled for rotation to a head adapter. The swivel adapter defines a bore extending therethrough. The swivel adapter also defines an outer surface over which a conduit can be positioned so that the conduit is in fluid communication with the bore defined by the swivel adapter. A coupler is positioned in an end of the conduit and defines a bore that extends therethrough, the bore being in fluid communication with the conduit. At least a portion of the coupler extends outwardly from the conduit to allow for a hose or other conduit to be coupled thereto.

In an embodiment of the present invention, the swivel adapter defines a first circumferential groove, and the head adapter defines a second circumferential groove. The first and the second circumferential grooves cooperate with one another to form inner and outer raceways. A plurality of balls is positioned between and in rolling engagement with the inner and outer raceways. The head adapter defines a bore that extends at least partway therethrough, and into the outer raceway. The plurality of balls is loaded through the bore and between the inner and outer raceways.

DETAILED DESCRIPTION

Figure 2:
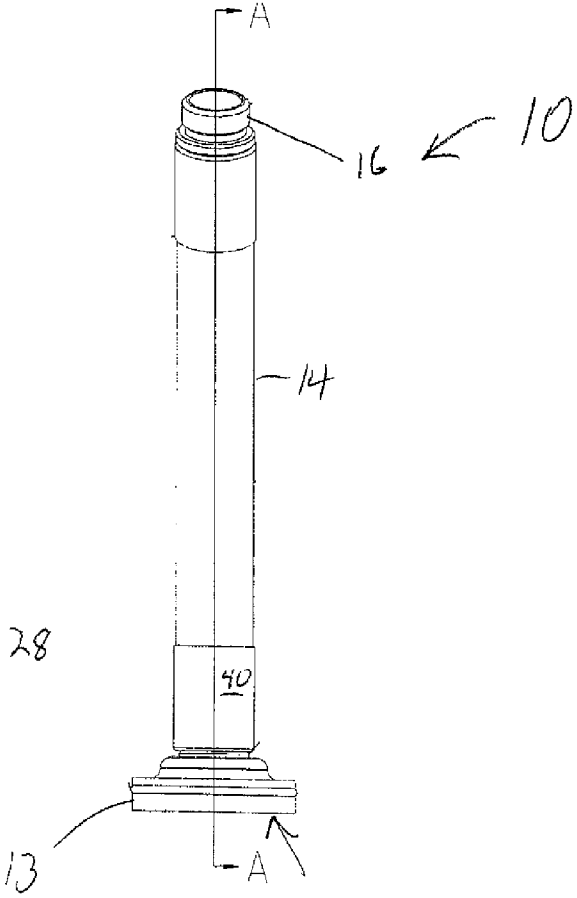
FIG. 2 is a side view of a sprinkler adapter.
Figure 1:
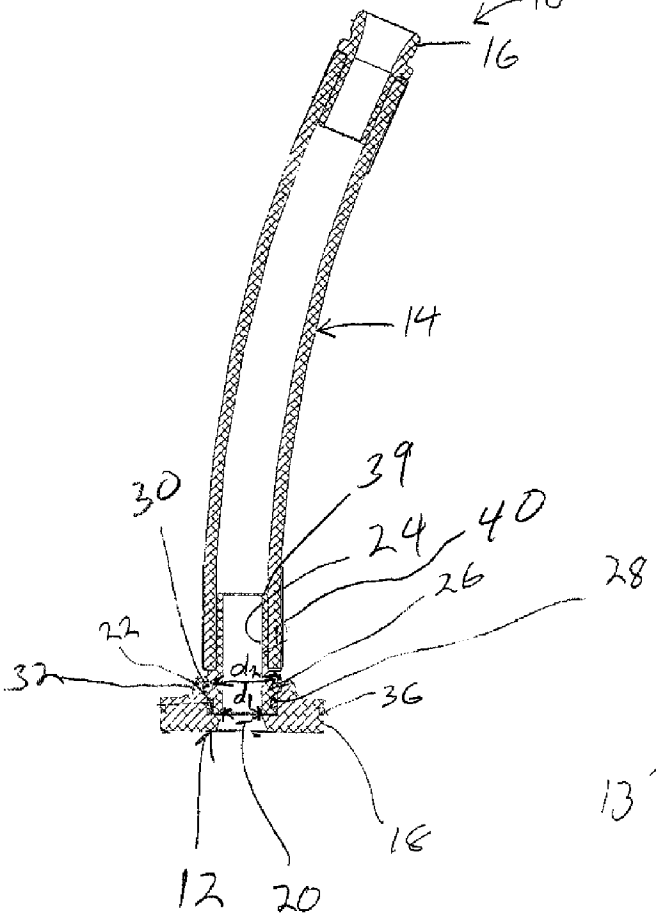
FIG. 1 is a cross-sectional side view of a sprinkler adapter.
Figure 3:
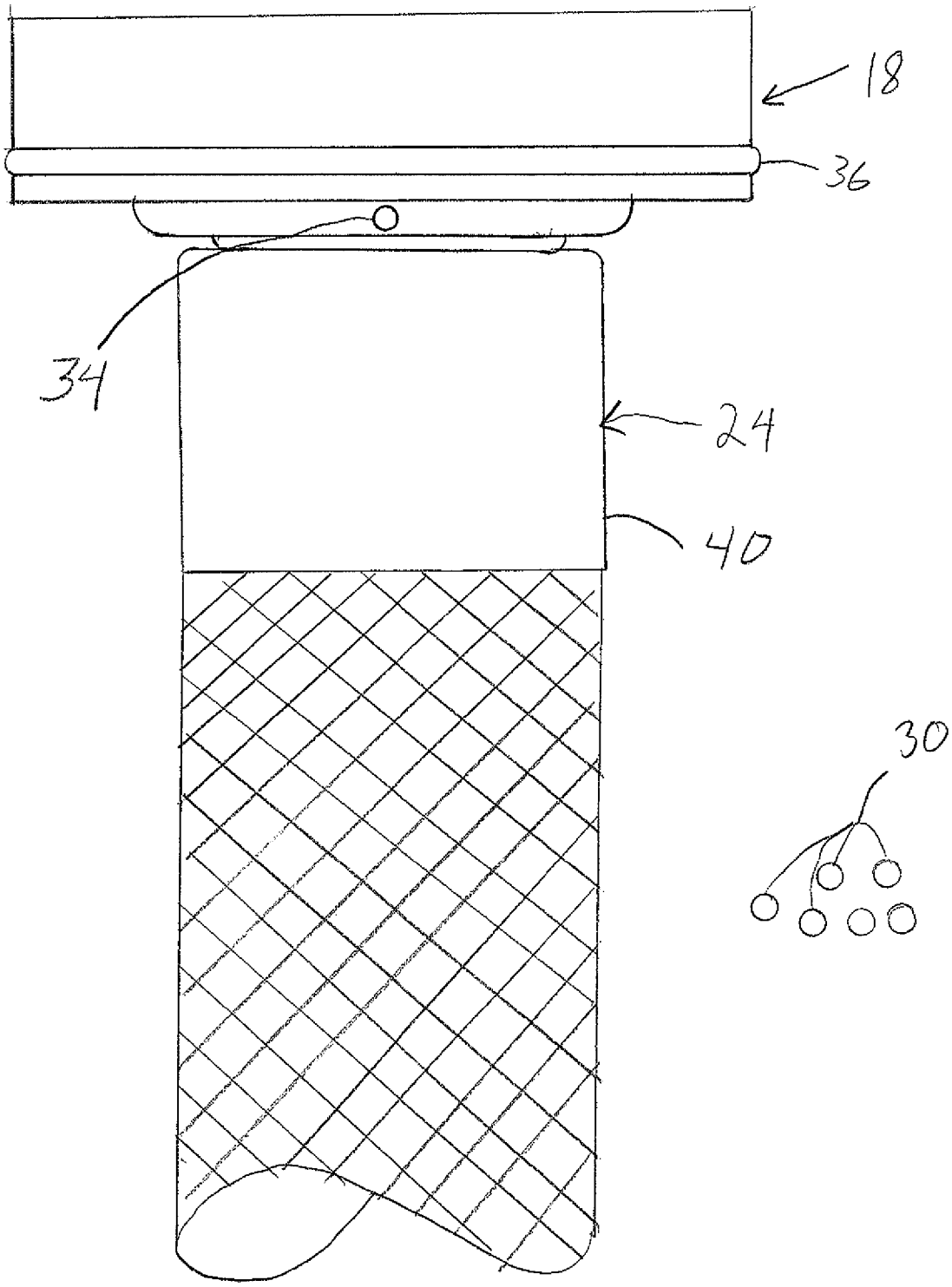
FIG. 3 is an enlarged view of the sprinkler adapter of FIGS. 1 and 2 and shows some of the internal components of the sprinkler adapter.

As shown in FIGS. 1-3, a sprinkler head hose adapter generally designated by the reference number 10 includes a swivel assembly 12 coupled to a conduit 14. As will be explained in greater detail below, the swivel assembly 12 allows the conduit 14 to rotate 360 degrees when the swivel assembly is attached to a sprinkler head. A coupler 16 is attached to the conduit 14 to allow a hose or other conduit to be coupled thereto.

The swivel assembly 12 includes a head adapter 18 having a bore 20 extending therethough. The bore 20 is defined by a first diameter d1 and a second diameter d2. In the illustrated embodiment, the diameter d2 is larger than the diameter d1, with a step being defined at the junction of the first and second diameters, d1 and d2, respectively, the step acting as a stop surface 22.

The above-described conduit 14 can be flexible or rigid.

Still referring to FIGS. 1-3, a swivel adapter 24 is positioned in the bore 20 for rotation relative to the head adapter 18. The swivel adapter 24 is prevented from passing through the bore 20 by the stop surface 22. The swivel adapter 24 defines a circumferential groove 26 that aligns with a similar circumferential groove 28 defined by the head adapter 18. The circumferential grooves 26 and 28 defined by the swivel and head adapters, 24 and 18 respectively, cooperate to form inner and outer raceways to rollingly receive a plurality of balls 30 therebetween. The balls 30 are rollingly positioned between the circumferential grooves 26 and 28, via a filling bore 32 defined by the head adapter 18. A set screw 34 is positioned in the filling bore 32 to prevent the balls 30 from exiting through the filling bore 32 once they have been loaded therethrough. While a set screw 34 has been shown and described, the present invention is not limited in this regard as other means of blocking the filling bore 32, known to those skilled in the art which the present invention pertains, may be employed. For example, a pin could be pressed or otherwise bonded in place within the filling bore 32. Alternatively, once the balls 30 are loaded into the swivel assembly 10, the filling bore 32 could be welded closed or filled with a polymer or elastomer. Once the balls are positioned in the circumferential grooves, 36 and 28, their rotation within the grooves allows the flexible conduit 14 to rotate relative to the head adapter 18.

Still referring to FIGS. 1 and 2, the head adapter 18 matingly engages a complementarily shaped recess that forms part of a sprinkler head. An O-ring 36 is positioned in an O-ring groove 38 defined by the head adapter 18.

In the illustrated embodiment, the conduit 14 is a polymeric hose reinforced with metal braid 37. However, the present invention is not limited in this regard as other types of flexible hose known to those skilled in the art to which the present invention pertains, may be employed without departing from the broader aspects of the invention.

The swivel adapter 24 defines an outer surface 39 over which an end of the conduit 14 is positioned. In the illustrated embodiment, a sleeve 40 is positioned over the end of the conduit 14 that engages the extension 39 forming part of the swivel adapter 24. The sleeve 40 adds hoop strength to the end of the flexible conduit 14, thereby increasing the strength of the connection between the extension 39 and the flexible conduit.

The coupler 16 shown in the illustrated embodiment is threaded such that a threaded male connector can be attached thereon. However, the present invention is not limited in this regard as other types of connectors, such as but not limited to, quick disconnect couplings can be employed. In addition, the coupler 16 can be a smooth or stepped sleeve onto which a hose can be pressed. A pipe clamp or similar device can be employed to retain the hose on the adapter.

Figure 6:
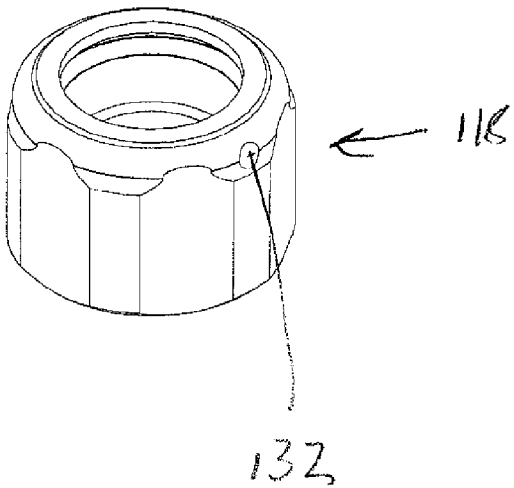
FIG. 6 is a perspective view of the head adapter of FIG. 4.
Figure 4:
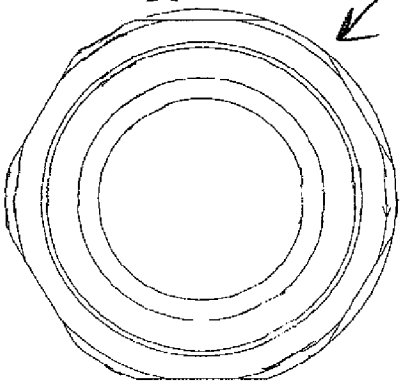
FIG. 4 is a top view of an alternate embodiment of the sprinkler adapter of the present invention.
Figure 5:
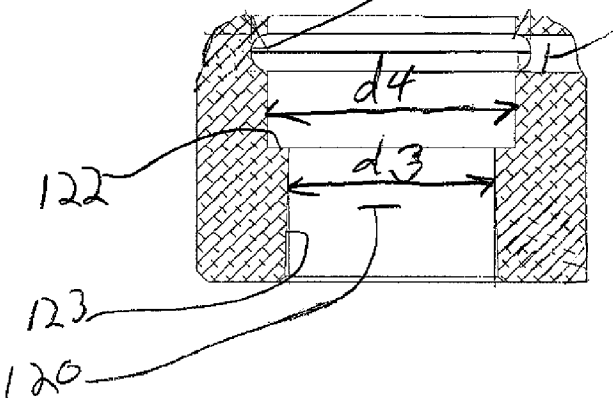
FIG. 5 is a cross-sectional side view of the head adapter of FIG. 4.

As shown in FIGS. 4-6, an alternative embodiment of the head adapter 18 is generally designated by the reference number 118. The head adapter 118 includes a stepped bore 120 having a first diameter d3 and a second diameter d4. A step defined by a stop surface 122 is formed at the junction between the first and second diameters, d3 and d4, respectively. The diameter d3, in the illustrated embodiment, is defined by a threaded bore wall 123 that threadably engages a male thread forming part of a sprinkler head. The diameter d4 is sized to allow the swivel adapter 24 (best seen in FIG. 1) to be rotatably positioned therein.

The head adapter 118 defines an arcuate groove 128 and a filling bore 132 into which the balls 30 can be loaded so that they are positioned for rotation between the circumferential groove defined by the swivel adapter 24 and the circumferential groove 128 defined by the head adapter, thereby allowing the head adapter to rotate relative to the swivel adapter.

Although the invention has been described with reference to particular embodiments thereof, it will be understood by one of ordinary skill in the art that numerous variations and alterations to the enclosed documents fall within the scope of the invention and the appended claims.

What is claimed is:

1. A sprinkler head hose adapter comprising:

a swivel adapter rotatably coupled to a head adapter, the swivel adapter defining a bore extending therethrough and an outer surface over which a conduit can be positioned so that the conduit is in fluid communication with the bore defined by the swivel adapter, wherein the swivel adapter defines a first circumferential groove and the head adapter defines a second circumferential groove, the first and second circumferential grooves cooperating to form inner and outer raceways;

a plurality of balls positioned between and in rolling engagement with the inner and outer raceways; and a coupler positioned in an end of the conduit and defining a bore extending therethrough and in fluid communication with the conduit, at least a portion of the coupler extending outwardly from the conduit to allow for a hose or other conduit to be coupled thereto.

2. A sprinkler head hose adapter as defined by claim 1 wherein:

the head adapter defines a bore extending at least partway therethrough so that the balls can be loaded between the inner and outer raceways through the bore.

3. A sprinkler head hose adapter as defined by claim 2 further comprising means for blocking the bore through which the balls are loaded.

4. A sprinkler head hose adapter as defined by claim 3 wherein the means for blocking is a set screw.

5. A sprinkler head hose adapter as defined by claim 1 wherein the conduit is flexible.

6. A sprinkler head hose adapter as defined by claim 5 wherein the conduit is reinforced with a metal mesh.

7. A sprinkler head assembly comprising:

a swivel adapter rotatably coupled to a head adapter, the swivel adapter defining a bore extending therethrough and an outer surface over which a conduit can be positioned so that the conduit is in fluid communication with the bore defined by the swivel adapter; and a coupler positioned in an end of the conduit and defining a bore extending therethrough and in fluid communication with the conduit, at least a portion of the coupler extending outwardly from the conduit to allow for a hose or other conduit to be coupled thereto;

wherein the head adapter includes a first bore defined by a first diameter and a second bore defined by a second diameter, the second diameter being larger than the first diameter, the head adapter defining a step at a junction formed by the first and second diameters, and wherein a bottom surface of the swivel adapter abuts the step.

8. A sprinkler head assembly as defined by claim 7 wherein the first bore is defined by a threaded circumferential surface adapted to threadably engage a conduit or connector forming part of a sprinkler system.

* * * * *